US009925804B2

(12) United States Patent
Rabin et al.

(10) Patent No.: US 9,925,804 B2
(45) Date of Patent: Mar. 27, 2018

(54) PRINTING INDEPENDENT IMAGES BY SHARING PRINTER HEADS

(71) Applicant: Electronics for Imaging, Inc., Fremont, CA (US)

(72) Inventors: Noam Rabin, San Jose, CA (US); Brian Fuerstneau, Minneapolis, MN (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 15/190,131

(22) Filed: Jun. 22, 2016

(65) Prior Publication Data

US 2017/0217167 A1 Aug. 3, 2017

Related U.S. Application Data

(60) Provisional application No. 62/289,146, filed on Jan. 29, 2016.

(51) Int. Cl.

| | |
|---|---|
| ***B41J 11/48*** | (2006.01) |
| ***B41J 15/22*** | (2006.01) |
| ***B41J 2/045*** | (2006.01) |
| ***B41J 2/155*** | (2006.01) |
| ***B41J 3/62*** | (2006.01) |
| ***B41J 3/54*** | (2006.01) |

(52) U.S. Cl.

CPC ..... *B41J 11/48* (2013.01); *B41J 2/04508* (2013.01); *B41J 2/04586* (2013.01); *B41J 2/155* (2013.01); *B41J 3/543* (2013.01); *B41J 3/62* (2013.01); *B41J 15/22* (2013.01)

(58) Field of Classification Search

CPC ... B41J 11/20; B41J 11/48; B41J 11/50; B41J 11/51; B41J 11/52; B41J 15/18; B41J 15/22; B41J 3/62; B41J 15/20

See application file for complete search history.

(56) References Cited

U.S. PATENT DOCUMENTS

| | | | | |
|---|---|---|---|---|
| 6,945,171 | B1 | 9/2005 | Coull | |
| 8,459,183 | B2 * | 6/2013 | Weingartner | B41J 3/407 101/35 |
| 2004/0036726 | A1 * | 2/2004 | Zach | B41J 3/28 347/12 |
| 2006/0092437 | A1 | 5/2006 | Martin | |
| 2009/0213157 | A1 | 8/2009 | Obertegger et al. | |

FOREIGN PATENT DOCUMENTS

| | | | | |
|---|---|---|---|---|
| WO | WO 2013/131746 | A1 * | 9/2013 | B41J 3/54 |

* cited by examiner

*Primary Examiner* — Geoffrey Mruk
(74) *Attorney, Agent, or Firm* — Perkins Coie LLP

(57) ABSTRACT

The disclosed embodiments include a printer having a printing area configured to receive distinct mediums, and printer heads arranged relative to the printing area. The printer heads are collectively configured to print independent images onto the distinct mediums. The printer heads include at least one shared printer head configured to simultaneously print portions of the independent images onto each of two adjacent mediums.

14 Claims, 8 Drawing Sheets

PRINTING INDEPENDENT IMAGES BY SHARING PRINTER HEADS

CROSS-REFERENCE TO RELATED APPLICATION

This application claims priority to U.S. Provisional Patent Application Ser. No. 62/289,146, filed Jan. 29, 2016, which is incorporated herein in its entirety by this reference.

TECHNICAL FIELD

The disclosed teachings relate to printing. The disclosed teachings more particularly relate to sharing a printer head to simultaneously print two independent images.

BACKGROUND

Printers can make persistent representations of images (e.g., including graphics or text) on paper or a similar physical medium. The two most common types of printers are laser printers and inkjet printers. Inkjet printers can have several printer heads that are fed ink via tubes from containers that include the ink. The printer heads include nozzles to eject the ink onto a physical medium. The printer heads collectively operate to print images onto distinct physical mediums (hereinafter the "mediums") as they are transported under the printer heads.

Many inkjet printers, in particular single pass printers, tend to use the entire width of the printer to print one or more print jobs simultaneously. For example, a printer that prints on ceramic tiles may print separate images on separate ceramic tiles simultaneously, where the ceramic tiles are placed side-by-side and each tile is printed by one or more of several distinct printer heads that are available for printing.

When printing multiple jobs simultaneously, each job is assigned to one or more dedicated inkjet heads per job. Thus, the size of any printed image for a job is limited by coverage determined by the size of the printer heads multiplied by the number of printer heads available. Moreover, printing multiple print jobs simultaneously is limited by the size of the printed images and the size and number of available printer heads dedicated per job. As such, the size of a job is limited by the number of available printer heads assignable to the job times the printing coverage that can be done by any of the printer heads. Hence, if a print job is smaller than a multiple head coverage, at least one printer head is underutilized. Thus, existing printers do not use printer heads efficiently and their ability to simultaneously print multiple jobs is limited.

SUMMARY

Introduced here are at least one apparatus and at least one method. The at least one apparatus can be a printer including a printing area configured to receive the mediums and printer heads arranged relative to the printing area. The printer heads are collectively configured to print independent images onto the mediums. The printer heads include at least one shared printer head configured to simultaneously print portions of the independent images onto each of two adjacent mediums.

In some embodiments, a method performed by a printing mechanism to print independent images by sharing a printer head includes receiving independent print jobs. Each print job can include an independent image. The method includes storing the independent images in memory. Each independent image includes portions, and each portion has a unique address in the memory. The method further includes mapping the addresses to locations of printer heads that are collectively configured to print the independent images and simultaneously printing at least some of the portions of the independent images onto each of two adjacent mediums by using a shared printer head. In some embodiments, the two adjacent mediums can have different dimensions with respect to each other.

In some embodiments, a method performed by a single printer head to simultaneously print portions of independent images onto the mediums includes retrieving portions of two independent images from memory based on corresponding addresses mapped to locations of the single printer head. The method further includes simultaneously printing the portions of the two independent images onto each of two adjacent mediums.

Other aspects of the disclosed embodiments will be apparent from the accompanying figures and detailed description.

This Summary is provided to introduce a selection of concepts in a simplified form that are further explained below in the Detailed Description. This Summary is not intended to identify key features or essential features of the claimed subject matter, nor is it intended to be used to limit the scope of the claimed subject matter.

DETAILED DESCRIPTION

Various example embodiments will now be described. The following description provides certain specific details for a thorough understanding and enabling description of these examples. One skilled in the relevant technology will understand, however, that some of the disclosed embodiments may be practiced without many of these details.

Likewise, one skilled in the relevant technology will also understand that some of the embodiments may include many known features not described in detail herein. Additionally, some well-known structures or functions may not be shown or described in detail below, to avoid unnecessarily obscuring the relevant descriptions of the various examples.

The terminology used below is to be interpreted in its broadest reasonable manner, even though it is being used in conjunction with a detailed description of certain specific examples of the embodiments. Indeed, certain terms may even be emphasized below; however, any terminology intended to be interpreted in any restricted manner will be overtly and specifically defined as such herein.

As used herein, unless specifically stated otherwise, terms such as "processing," "computing," "calculating," "determining," "displaying," "generating," or the like, refer to actions and processes of a computer or similar electronic computing device, which manipulates and transforms data represented as physical (electronic) quantities within the computer's memory or registers into other data similarly represented as physical quantities within the computer's memory, registers, or other such storage medium, transmission, or display devices.

As used herein, the terms "connected," "coupled," or variants thereof, mean any connection or coupling, either direct or indirect, between two or more elements. The coupling or connection between the elements can be physical, logical, or a combination thereof.

Disclosed embodiments include a printing mechanism that enables efficient use of an available printing area to print multiple print jobs simultaneously. The printer includes several printer heads that are arranged to cover an entire printing area. The printing mechanism includes printer heads that print images onto the mediums in accordance with the print jobs. At least one shared printer head simultaneously prints portions of independent images from different print jobs onto the mediums, which are transported side-by-side under the printer heads. As such, the use of available printer heads can be maximized when printing multiple independent jobs by simultaneously sharing one or more printer heads.

Figure 1:
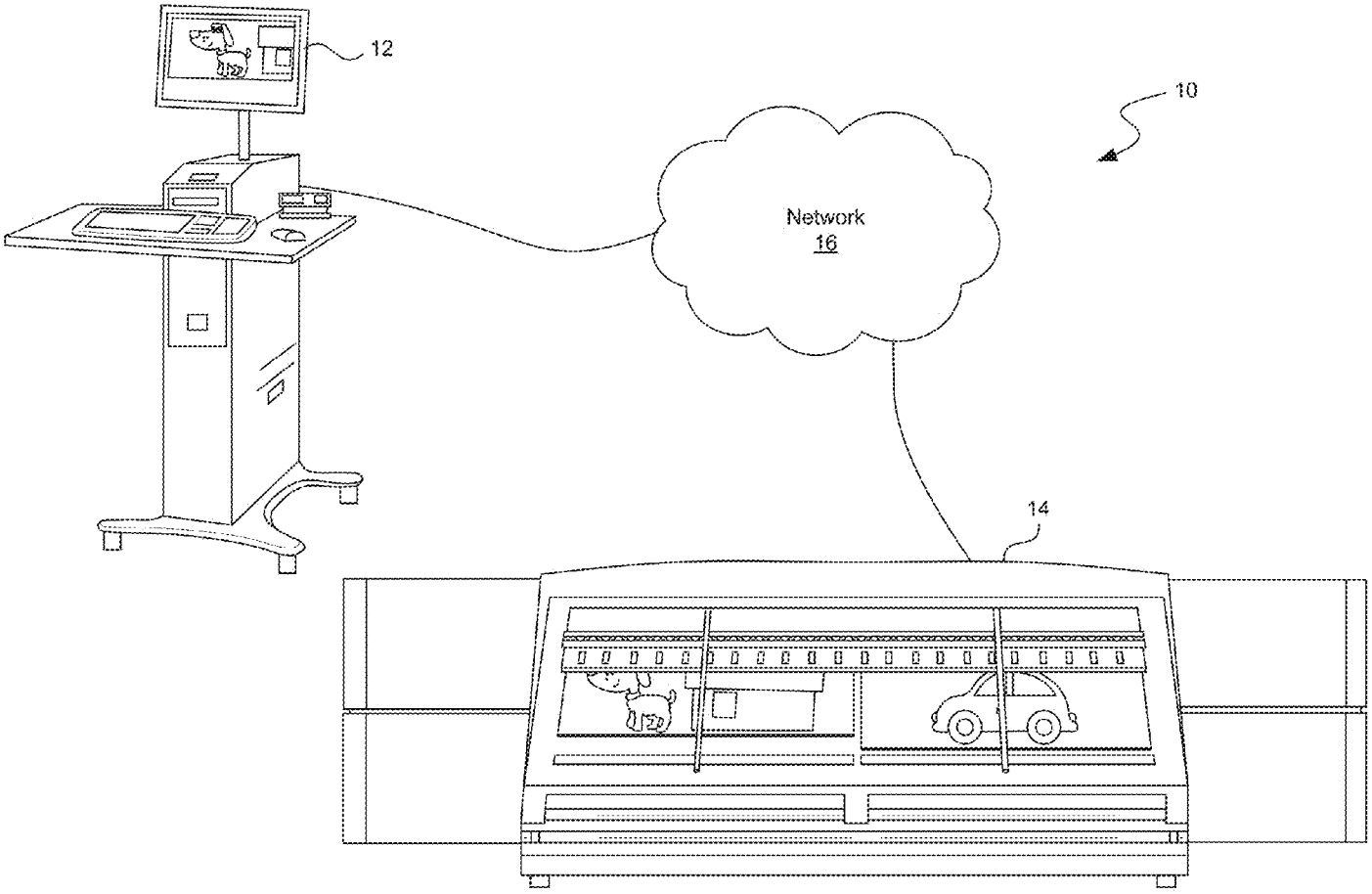
FIG. 1 is a block diagram of a printing system according to some embodiments of the present disclosure.

FIG. 1 is a block diagram of a printing system 10 according to some embodiments of the present disclosure. The printing system includes a computer 12 connected to a printer 14 over a network 16. The network 16 may include a combination of private, public, wired, or wireless portions. In some embodiments, the computer 12 can be connected to the printer 14 via a network or on a separate cooper of fiber cable using standard or propriety protocols. Data communicated over the network 16 may be encrypted or unencrypted at various locations or portions of the network 16. The computer 12, printer 14, and any other component of the printing system 10 may include combinations of hardware and/or software to process data, perform functions, communicate over the network 16, and the like.

Any component of the printing system 10 may include a processor, memory or storage, a network transceiver, a display, an operating system and application software (e.g., for providing a user interface), and the like. Other components, hardware, and/or software included in the printing system 10 that are well known to persons skilled in the art are not shown or discussed herein for brevity.

The computer 12 may include any computing devices such as a server, desktop or laptop computers (e.g., Apple MacBook, Lenovo 440), handheld mobile devices (e.g., Apple iPhone, Samsung Galaxy, Microsoft Surface), and any other electronic computing device, or combinations thereof. A user can use the computer 12 to send print jobs to the printer 14 over the network 16.

As used herein, the term "print job" refers to a file or set of files including one or more images to be printed by the printer 14. Different print jobs can be distinguished by a unique identifier and are assigned to a particular destination, usually a printer (e.g., printer 14). A print job may include instructions that control how a printer is to print images. For example, a print job can include instructions regarding options such as medium type, number of copies, and priority. As such, one or more print jobs can be communicated from the computer 12 over the network 16 to the printer 14.

As used herein, the term "printing mechanism" refers to any device or component that is configured to make a persistent human-readable representation of images (e.g., graphics or text) on paper, tile, or any other physical medium. The printer 14 is an example of a device that includes a printing mechanism.

The printer 14 can be an inkjet printer that prints an image on a medium by propelling droplets of ink onto the medium. The printer 14 is described functionally as an inkjet printer to aid in understanding, but the disclosed concepts are not limited to this particular embodiment. Instead, the printer 14 can be any type of printer that uses an arrangement of multiple modular components (e.g., printer heads) to print images onto multiple mediums. The printer 14 can be a single-pass printer or a multi-pass printer.

With single-pass printing technology, printer heads can use cyan-, magenta-, yellow-, and black-colored ink dispensed at the same time. In particular, an image is printed onto a medium by passing the medium through a printing area that includes an arrangement of the printer heads that propel the ink from cartridges onto the medium.

With multi-pass printing technology, printing involves multiple "passes" under one or more printer heads. A head may be able to dispense only one type of ink at a time. To produce full-color results, a medium may need to pass beneath a single head four separate times. With each pass, different colors of ink are dispensed onto the medium to collectively print an image.

The printer 14 can print multiple print jobs simultaneously. That is, the printer 14 can print two or more images from print jobs onto different mediums at the same time. For example, the printer 14 can print onto two or more mediums that are processed side-by-side in a printing area of the printer 14. The images printed on the two or more mediums can be independent images from asynchronous print jobs. That is, the printer 14 can print different images on different mediums at the same time in accordance with respective print jobs that are processed asynchronously by the printer 14.

The disclosed embodiments concern sharing an individual printer head (hereafter the "shared printer head") from among several printer heads in a printer (e.g., printer 14). The printer 14 can be a single-pass printer that processes multiple print jobs simultaneously by dividing use of the printer heads between the multiple print jobs. As such, two independent images from asynchronous print jobs running independently can be printed simultaneously on two adjacent mediums by using the same shared printer head. Use of the shared printer head may be divided equally or unequally between two print jobs to print images on different mediums that are being processed side-by-side. The embodiments can provide maximum use of inkjet printer heads available thus lowering the total cost of a printer with no sacrifice in performance.

In contrast, existing printers use printer heads that are each dedicated to a single print job. Thus, printing multiple print jobs simultaneously would require dividing the total number of printer heads in a printing area between the multiple jobs. If the width of a printing area is less than the sum total printing width of the multiple jobs, then one print job will have to print after the other print job is complete (i.e., print in sequence, not simultaneously). Even if the sum total printing width of the multiple print jobs is less than the total width of the printing area, the print jobs may still need to print in sequence if the images of the print jobs overlap any one printer head.

Some existing printers use numerous and relatively small printer heads, which reduces the likelihood that printing any two print jobs would cause an overlap in any single printer head. However, printing technology has evolved to use relatively larger printer heads that provide, for example, printed images with greater resolution. As a result, the likelihood that simultaneously printing multiple print jobs will overlap any single printer head is greatly increased. The disclosed embodiments overcome at least these drawbacks.

Figure 2:
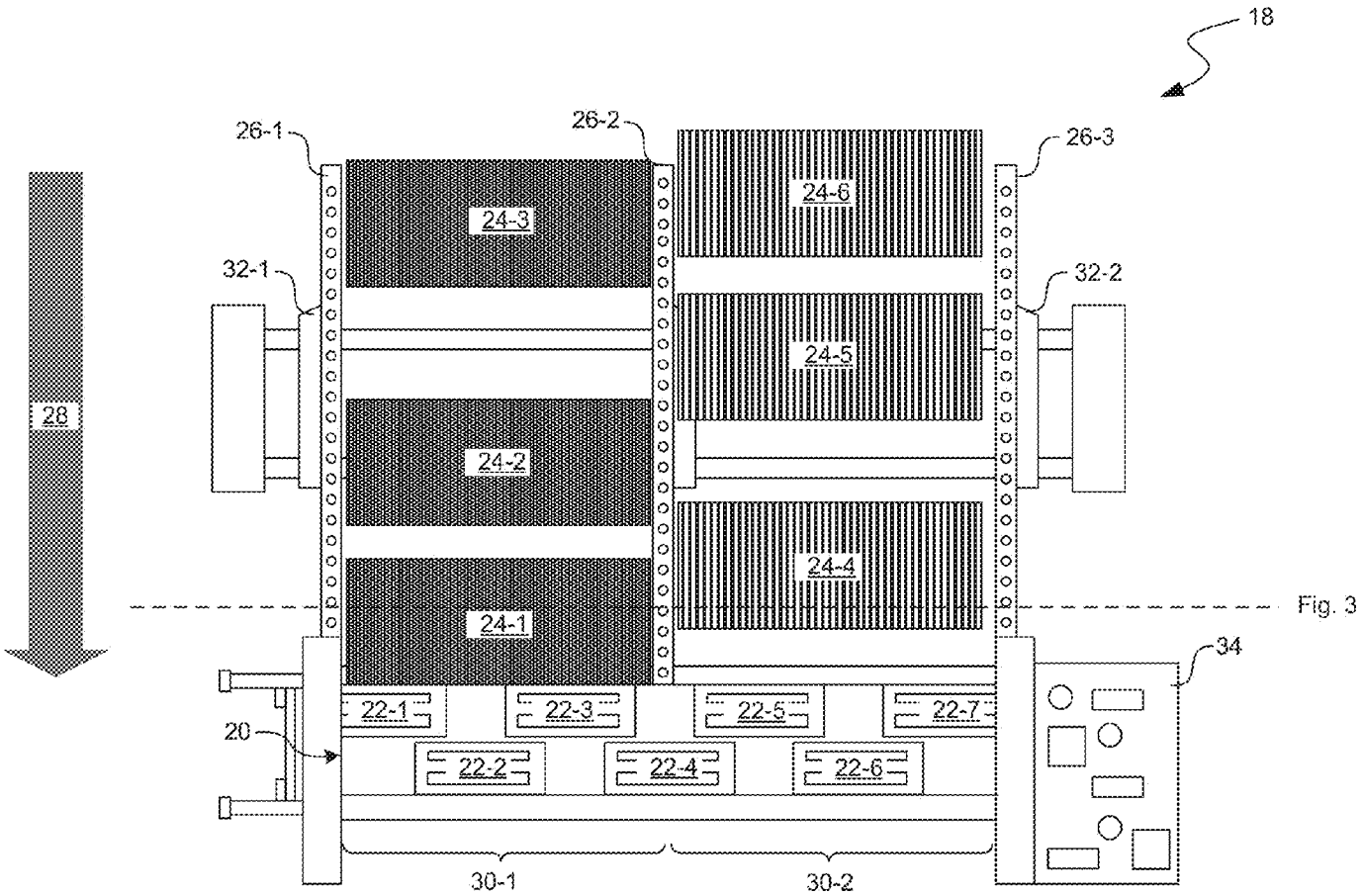
FIG. 2 is a diagram illustrating a printing mechanism operable to efficiently print images from two independent print jobs by sharing a printer head according to some embodiments of the present disclosure.

FIG. 2 is diagram illustrating a printing mechanism 18 operable to efficiently print images from two independent print jobs by sharing a printer head according to some embodiments of the present disclosure. The printing mechanism 18 includes a printing area 20 that includes an arrangement of printer heads 22 (referred to collectively as printer heads 22 and individually as printer heads 22-1 through 22-7).

The printing area 20 is configured to receive the mediums 24 (referred to collectively as mediums 26 and individually as mediums 24-1 through 24-6). Images from print jobs are printed onto the mediums 24. The mediums 24 can be transported by railings 26-1, 26-2, and 26-3 in a direction shown by the arrow 28 towards the printing area 20. As such, the railings 26-1, 26-2, and 26-3 can feed the mediums 24 to the printing area 20.

The number of mediums that can simultaneously pass under the printing area 20 depend on their dimensions and orientations. For example, the mediums 26 have dimensions and are oriented such that only two mediums 26 can pass under the printing area 20 at the same time. In contrast, for example, a greater number of narrow mediums can pass in parallel through the printing area 20 simultaneously.

The printer heads 22 are arranged in the printing area 20 and collectively configured to print one or more independent images simultaneously onto the mediums 24 (e.g., print onto mediums 24-1 and 24-4 at the same time). Specifically, the printer heads 22 are arranged such that they can collectively print in an area that spans the width of the printing area 20, as mediums 24 pass under the printing area 20.

The printing area 20 is allocated for different printing lanes 30-1 and 30-2 (collectively referred to as lanes 30) for printing the independent images from print jobs onto the mediums 24. The mediums 24 track the printing lanes 30 in parallel such that the printer heads 22 can print the independent images at the same time on the two adjacent mediums 24-1 and 24-4 on lanes 30-1 and 30-2, respectively.

The printing mechanism 18 includes sensors 32-1 and 32-2 (referred to collectively as sensors 32). The sensors 32 are configured to detect parameters of the mediums 24 relative to the printer heads 22 in respective printing lanes 30. The detected parameters can include position, rate of movement, and the like. For example, the sensor 32-1 can detect the position and movement of mediums 24-1 through 24-3 relative to the printer heads 22-1 through 22-4 in printing lane 30-1. Likewise, the sensor 32-2 can detect the position and movement of mediums 24-4 through 24-6 relative to the printer heads 22-4 through 22-7 in printing lane 30-2.

A printing engine 34 can control the printer heads 22 to print independent images onto the mediums 24 in accordance with the print jobs. In some embodiments, the printing engine 34 can control printing of the independent images onto the mediums 24 based on the detected parameters of the mediums 24. For example, the printing engine 34 can control printer heads 22-1 through 22-4 to begin printing on medium 24-1 before printer heads 22-4 through 22-7 begin printing on medium 24-4, in accordance with their respective detected rates of movement towards the printing area 20.

The printing mechanism 18 can process multiple synchronous or asynchronous print jobs. Specifically, the printing mechanism 18 can process print jobs in parallel that traverse respective printing lanes 30-1 and 30-2 at the same time or different times. As a result, the printing mechanism 18 can print independent images asynchronously between different printing lanes 30. Further, the spacing between mediums 24 in the same lane 30 may be uneven and/or leading edges between any two mediums 24 may be uneven.

The shared printer head 22-4 can print portions of independent images onto adjacent mediums 24-1 and 24-4, 24-2 and 24-5, and 24-3 and 24-6 in respective printing lanes 30-1 and 30-2 as the mediums 24 pass under the printer heads 22.

Figure 3:
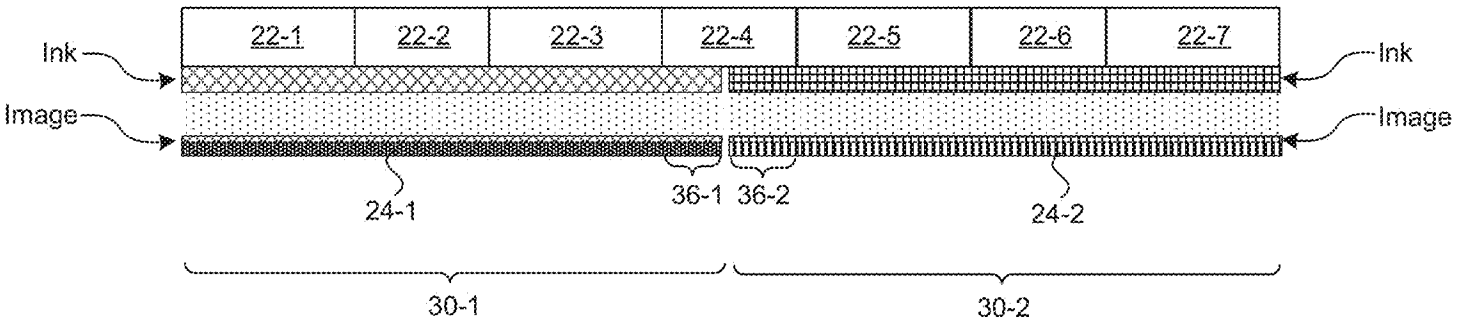
FIG. 3 is a diagram illustrating relative proportions of printer heads collectively configured to simultaneously print two independent images onto mediums according to some embodiments of the present disclosure.

FIG. 3, for example, is a diagram illustrating relative proportions of printer heads 22 collectively configured to simultaneously print two independent images onto mediums 26-1 and 26-2 according to some embodiments of the present disclosure. The shared printer head 22-4 can print portions 36-1 and 36-2 of images from independent print jobs onto mediums 24-1 and 24-2, respectively, at the same time. The printing area 20 can be allocated equally or unequally among print jobs. The remaining printer heads 22 are dedicated to separately printing distinct print jobs. In particular, printer heads 22-1 through 22-3 are dedicated to printing an image on medium 26-1, and printer heads 22-5 through 22-7 are dedicated to printing an image on medium 26-2.

Figure 4:
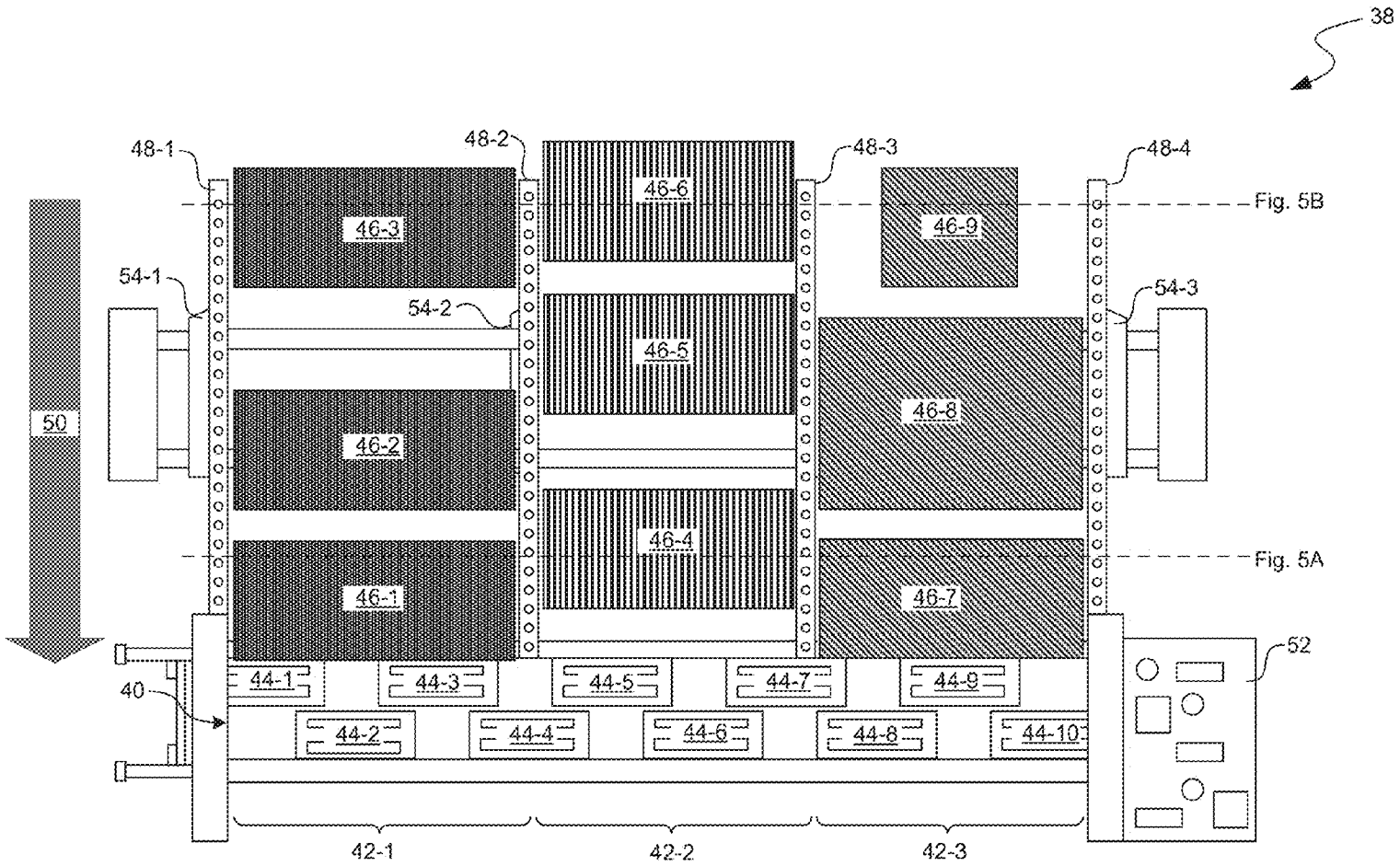
FIG. 4 is diagram illustrating a printing mechanism that increases the use of a printer heads for three independent print jobs by sharing two printer heads according to some embodiments of the present disclosure.

FIG. 4 is diagram illustrating a printing mechanism 38 operable to efficiently print images for three independent print jobs by sharing two printer heads according to some embodiments of the present disclosure. The printing mechanism 38 is analogous to the printing mechanism 18 of FIG. 2 but is expanded to include an additional printing lane for an additional print job.

In particular, the printing mechanism 38 has a printing area 40 allocated between three printing lanes 42-1, 42-2, and 42-3 (referred to collectively as printing lanes 42 and individually as printing lanes 42-1 through 42-3). The printing area 40 includes 10 printer heads 44 (referred to collectively as printer heads 44 and individually as printer heads 44-1 through 44-10) that are collectively configured to receive mediums 46 (referred to collectively as mediums 46 and individually as mediums 46-1 through 46-9). The mediums 46 can have variable dimensions. For example, medium 46-8 has an elongated length compared to the remaining mediums, and medium 46-9 has a shortened width compared to the remaining mediums.

The mediums 46 are transported by railings 48-1 through 48-4 (referred to collectively as railings 48) in a direction shown by the arrow 50 towards the printing area 40. As such, the railings 48 feed the mediums 46 to the printing area 40. A printing engine 52 controls the printing by the printer heads 44 onto the mediums 46 in accordance with print jobs. The printing lanes 42 are configured to receive the mediums 46 in parallel such that the printer heads 44 are collectively configured to print independent images at the same time on three adjacent mediums.

The printing mechanism 38 includes sensors 54-1, 54-2, and 54-3 configured to detect parameters of mediums 46 received in printing lanes 42-1, 42-2, and 42-3, respectively. The parameters detected by the sensors 54 are used by the printing engine 52 to control printing of independent images on the mediums 46 based on the detected parameters of the mediums 46.

Figure 5A:
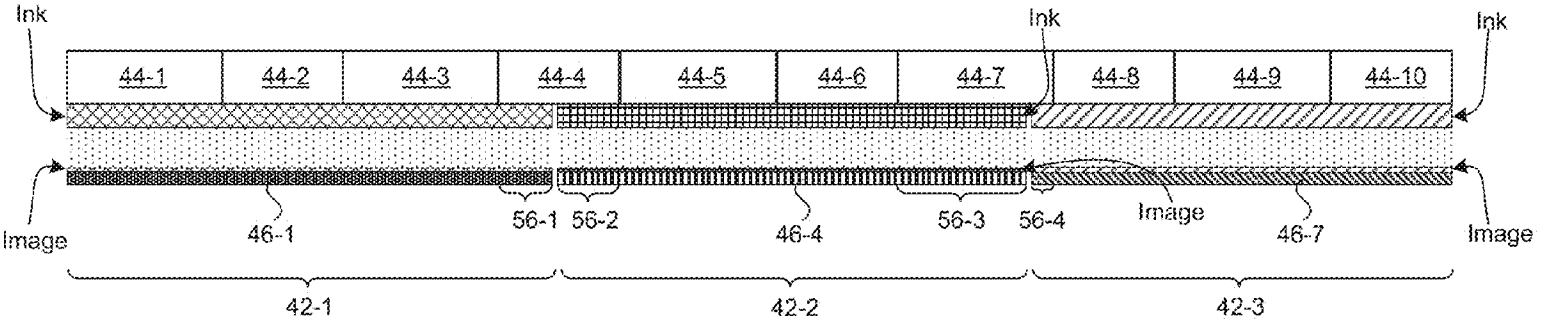
FIG. 5A is a diagram illustrating relative proportions of the printer heads configured to print three independent images on three mediums having relatively equal spacing between each other according to some embodiments of the present disclosure.
Figure 5B:
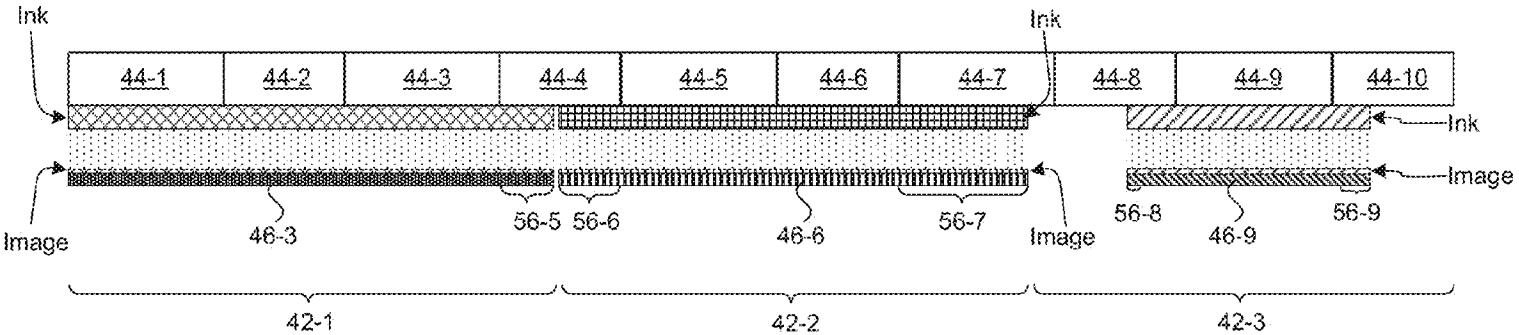
FIG. 5B is a diagram illustrating relative proportions of the printer heads configured to print three independent images on three mediums having unequal spacing between each other according to some embodiments of the present disclosure.

FIGS. 5A and 5B are diagrams illustrating relative proportions of the printer heads 44 collectively configured to simultaneously print three independent images according to some embodiments of the present disclosure. In particular, FIG. 5A is a diagram illustrating relative proportions of the printer heads 44 configured to print three independent images on the three mediums 46-1, 46-4, and 46-7 having relatively equal spacing between each other according to some embodiments of the present disclosure.

The printer heads 44 include two shared printer heads 44-4 and 44-7 that can print portions of independent images from different print jobs onto different mediums 46 at the same time. In particular, the shared printer head 44-4 can print portions 56-1 and 56-2 of independent images from independent print jobs onto mediums 46-1 and 46-4, respectively, at the same time. Similarly, the shared printer head 44-7 can print portions 56-3 and 56-4 of images from independent print jobs onto mediums 46-4 and 46-7, respectively, at the same time.

The remaining printer heads 44 are all dedicated to print jobs in respective printing lanes 42. Specifically, printer heads 44-1, 44-2, and 44-3 are dedicated to a print job on printing lane 42-1; printer heads 44-5 and 44-6 are dedicated to a print job on printing lane 42-2; and printer heads 44-8, 44-9, and 44-10 are dedicated to a print job on printing lane 42-3.

FIG. 5B is a diagram illustrating relative proportions of the printer heads 44 configured to print three independent images on three mediums 46-3, 46-6, and 46-9 having unequal spacing between each other according to some embodiments of the present disclosure. The printer heads 44 include a single shared printer head 44-4 that can print portions 56-5 and 56-6 of independent images from different print jobs onto mediums 46-3 and 46-6, respectively, at the same time. The remaining printer heads 44 are all dedicated to print jobs in respective printing lanes 42. Unlike the configuration of FIG. 5A, the printer head 44-7 is dedicated to printing only a portion 56-7 of an image on the medium 46-6 in printing lane 42-2. Further, the printer heads 44-8 and 44-10 are dedicated to printing only portions 56-8 and 56-9, respectively, on the medium 46-9. As such, any of the printing heads 44 can remain partially or totally unused when printing multiple print jobs at the same time.

Embodiments of the printing mechanisms are not limited to those shown in FIGS. 1 through 5. Instead, a printing mechanism may include any number and combination of printing lanes, printer heads, and sensors to provide a desired configuration for printing multiple synchronous or asynchronous print jobs. Specifically, the printing mechanism can process print jobs in parallel that are received on respective printing lanes at the same time or different times. As a result, embodiments of the disclosed printing mechanism can print independent images asynchronously between different printing lanes.

In some embodiments, various processes are involved in simultaneously printing independent images on distinct mediums.

Figure 6:
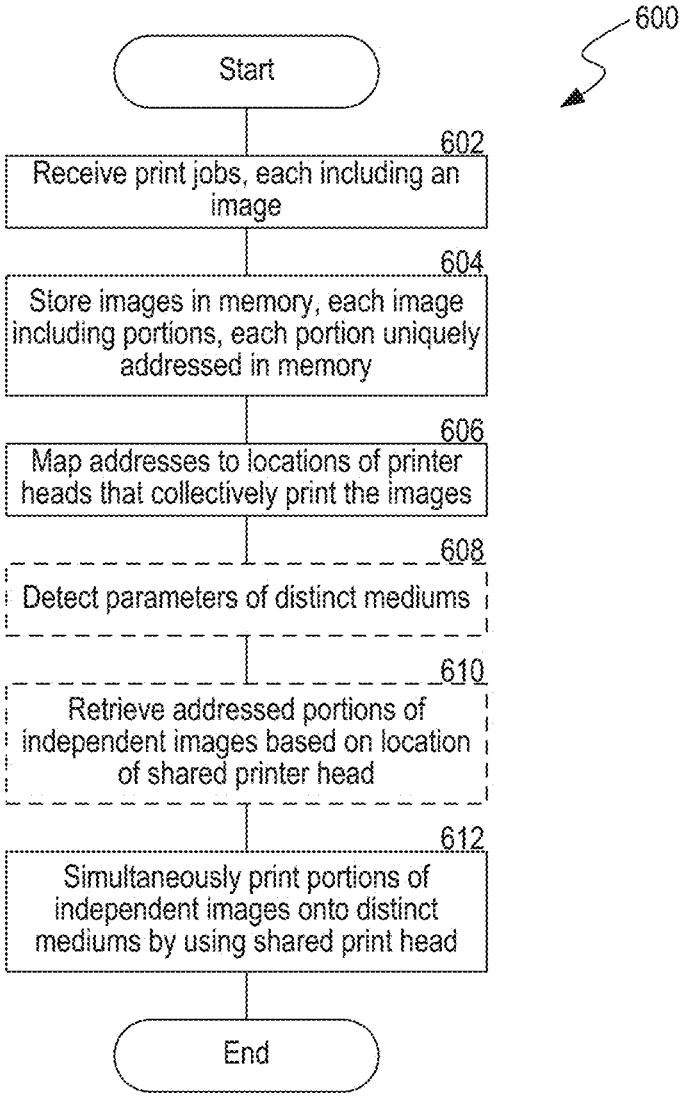
FIG. 6 is a flowchart showing a process performed by a printing mechanism to print independent images by sharing a printer head according to some embodiments of the present disclosure.

FIG. 6 is a flowchart showing a process 600 performed by a printing mechanism to print independent images by sharing a printer head according to some embodiments of the present disclosure.

In step 602, the printing mechanism receives a plurality of independent print jobs. The print jobs may be synchronous or asynchronous, and each of the print jobs includes an independent image. In step 604, independent images are stored in memory. The memory may be located proximate to the printing mechanism (e.g., contained in printer 14) or remote from the printing mechanism (e.g., contained within the computer 12 and accessible under the network 16). Each stored image can include portions that are uniquely addressed in the memory. For example, any image can be divided into lines associated with unique addresses in the memory.

In step 606, the addresses are mapped to physical locations of printer heads that collectively print the independent images. In optional step 608, sensors may detect parameters of the distinct mediums (e.g., positions and rate of movement). The detected parameters may be used by the printer heads to print the print jobs. In optional step 610, the portions of the images are retrieved for a shared printer head by using corresponding addresses mapped to the location of the shared printer head such that the simultaneously printing is based on the location of the shared printer head. Lastly, in step 612, the portions of independent images are simultaneously printed by the shared printer head.

Figure 7:
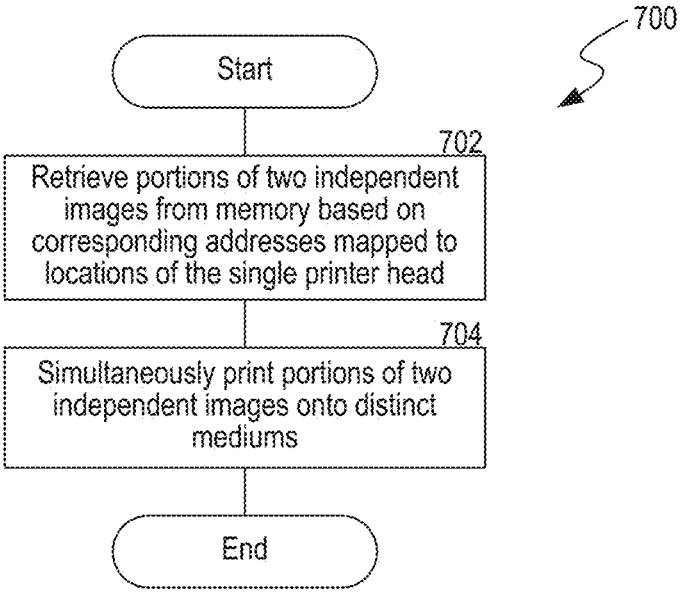
FIG. 7 is a flowchart showing a process performed by a single printer head to simultaneously print portions of independent images according to some embodiments of the present disclosure.

FIG. 7 is a flowchart showing a process 700 performed by a single shared printer head to simultaneously print portions of independent images according to some embodiments of the present disclosure. In step 702, portions of two independent images are retrieved from memory based on corresponding addresses mapped to locations of the single shared printer head. In step 704, the portions of the two independent images are simultaneously printed onto distinct mediums.

The simultaneous printing of the portions of the two independent images onto the mediums is based on detected locations of the mediums and detected rates that the mediums are traveling to the shared printer head.

Figure 8:
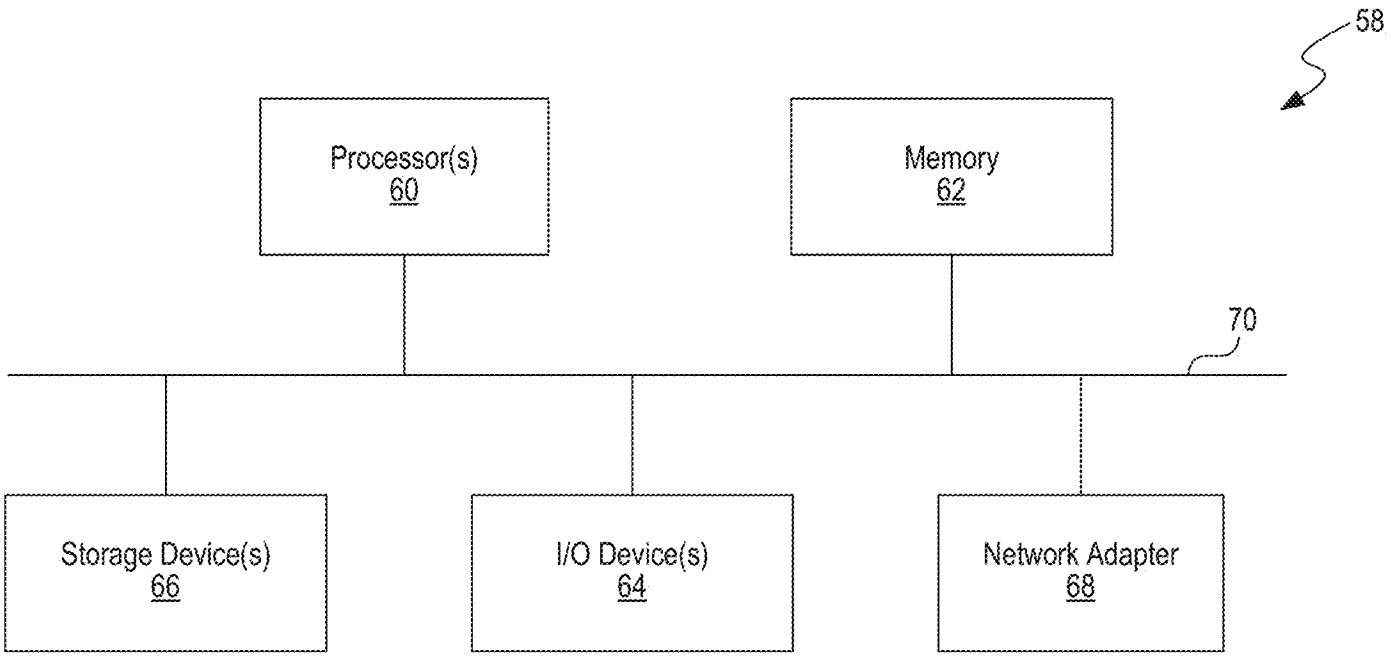
FIG. 8 is a block diagram of a computer operable to implement the disclosed technology according to some embodiments of the present disclosure.

FIG. 8 is a block diagram of a computer 58 of system 10 operable to implement the disclosed technology according to some embodiments of the present disclosure. The computer 58 may be a server computer; a client computer; a personal computer (PC); a user device; a tablet PC; a laptop computer; a personal digital assistant (PDA); a cellular telephone; an iPhone; an iPad; a Blackberry; a processor; a telephone; a web appliance; a network router; a switch or bridge; a console; a hand-held console; a (hand-held) gaming device; a music player; any portable, mobile, hand-held device or wearable device; or any machine capable of executing a set of instructions (sequential or otherwise) that specifies actions to be taken by that machine.

The computer 58 may include one or more central processing units ("processor(s)") 60, memory 62, input/output devices 64 (e.g., keyboard and pointing devices, touch devices, display devices), storage devices 66 (e.g., disk drives), and network adapters 68 (e.g., network interfaces) that are connected to an interconnect 70. The interconnect 70 is illustrated as an abstraction that represents any one or more separate physical buses, point-to-point connections, or both that are connected by appropriate bridges, adapters, or controllers. Therefore, the interconnect 70 may include, for example, a system bus, a peripheral component interconnect (PCI) bus or PCI-Express (PCI-E) bus, a HyperTransport or industry standard architecture (ISA) bus, a small computer system interface (SCSI) bus, a universal serial bus (USB), inter-integrated circuit (12C) bus, or an Institute of Electrical and Electronics Engineers (IEEE) standard 1394 bus, also called "Firewire."

The memory 62 and storage devices 66 are computer-readable storage media that may store instructions that implement at least portions of the various embodiments. In addition, the data structures and message structures may be stored or transmitted via a data transmission medium (e.g., a signal on a communications link). Various communications links may be used (e.g., the Internet, a local area network, a wide area network, or a point-to-point dial-up connection). Thus, computer-readable media can include computer-readable storage media (e.g., "non-transitory" media) and computer-readable transmission media.

The instructions stored in memory 62 can be implemented as software and/or firmware to program the processor(s) 60 to carry out actions described above. In some embodiments, such software or firmware may be initially provided to the processor(s) 60 by downloading it from a remote system through the computing system 58 (e.g., via network adapter 68).

The various embodiments introduced herein can be implemented by, for example, programmable circuitry (e.g., one or more microprocessors) programmed with software and/or firmware, or entirely in special-purpose hardwired (non-programmable) circuitry, or in a combination of such forms. Special-purpose hardwired circuitry may be in the form of, for example, one or more ASICs, PLDs, FPGAs, etc.

A software program, when referred to as "implemented in a computer-readable storage medium," includes computer-readable instructions stored in memory (e.g., memory 62). A processor (e.g., processor 60) is "configured to execute a software program" when at least one value associated with the software program is stored in a register that is readable by the processor. In some embodiments, routines executed to implement the disclosed embodiments may be implemented as part of the Operating System (OS) software (e.g., Microsoft Windows®, Linux®) or a specific software application, component, program, object, module, or sequence of instructions, referred to as "computer programs."

As such, the computer programs typically comprise one or more instructions set at various times in various memory devices of a computer (e.g., computer 58) and which, when read and executed by a at least one processor (e.g., processor (s) 60), cause the computer to perform operations to execute features involving the various aspects of the disclosure embodiments. In some embodiments, a carrier containing the aforementioned computer program product is provided. The carrier is one of an electronic signal, an optical signal, a radio signal, or a non-transitory computer-readable storage medium (e.g., the memory 62).

Operation of a memory device (e.g., memory 62), such as a change in state from a binary one to a binary zero (or vice-versa) may comprise a visually perceptible physical transformation. The transformation may comprise a physical transformation of an article to a different state or thing. For example, a change in state may involve accumulation and storage of charge or release of stored charge. Likewise, a change of state may comprise a physical change or transformation in magnetic orientation or a physical change or transformation in molecular structure, such as from crystalline to amorphous or vice versa.

Aspects of the disclosed embodiments may be described in terms of algorithms and symbolic representations of operations on data bits stored on memory. These algorithmic descriptions and symbolic representations generally include a sequence of operations leading to a desired result. The operations require physical manipulations of physical quantities. Usually, though not necessarily, these quantities take the form of electrical or magnetic signals capable of being stored, transferred, combined, compared, and otherwise manipulated. Customarily and for convenience, these signals are referred to as bits, values, elements, symbols, characters, terms, numbers, or the like. These and similar terms are associated with physical quantities and are merely convenient labels that are applied to these quantities.

The above description and drawings are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not all necessarily referring to the same embodiment, nor are separate or alternative embodiments mutually exclusive of other embodiments. Moreover, various features are described, which may be exhibited by some embodiments and not by others. Similarly, various requirements are described, which may be requirements for some embodiments but not for other embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted; for example, using italics and/or quotation marks. The use of highlighting has no influence on the scope and meaning of a term, the scope and meaning of a term is the same, in the same context, whether or not it is highlighted. It will be appreciated that the same thing can be said in more than one way. One will recognize that "memory" is one form of a "storage" and that the terms may, on occasion, be used interchangeably.

Consequently, alternative language and synonyms may be used for any one or more of the terms discussed herein, and no special significance is to be placed upon whether or not a term is elaborated or discussed herein. Synonyms for certain terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given above. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

The invention claimed is:

1. A printer, comprising:

a printing area configured to receive a plurality of distinct mediums;

a plurality of printer heads arranged relative to the printing area and collectively spanning a width of the printing area; and a printer engine configured to cause the plurality of printer heads to collectively print a plurality of independent images simultaneously onto the plurality of distinct mediums traversing the printing area in a direction perpendicular to the width of the printing area, the printer engine configured to cause the plurality of printer heads to include:

a plurality of dedicated printer heads, each dedicated printer head configured to print at least a portion of only one independent image of the plurality of independent images; and at least one shared printer head configured to simultaneously print at least portions of at least two of the plurality of independent images onto each of two respective adjacent distinct mediums of the plurality of distinct mediums.

2. The printer of claim 1, wherein the printing area comprises:

a plurality of printing lanes configured to receive the plurality of distinct mediums in parallel such that the plurality of printer heads are collectively configured to simultaneously print the plurality of independent images, and the shared printer head is configured to print the portions of the plurality of independent images onto the adjacent distinct mediums in respective printing lanes.

3. The printer of claim 2, further comprising:

a plurality of sensors configured to detect parameters of the plurality of distinct mediums relative to respective printing lanes, wherein the plurality of printer heads print the plurality of independent images based on the detected parameters of the plurality of distinct mediums.

4. The printer of claim 3, wherein the plurality of sensors comprise respective sensors configured to detect parameters of the plurality of distinct mediums in each of the plurality of lanes relative to the printer heads in respective printing lanes.

5. The printer of claim 2, wherein the printer is configured to print the plurality of independent images asynchronously with respect to different printing lanes.

6. The printer of claim 5, wherein the adjacent distinct mediums have leading edges at different offsets from the printing area.

7. The printer of claim 5, wherein the printer is configured to print on a series of distinct mediums in a same printing lane, the series of distinct mediums having a first spacing between a first set of distinct mediums of the series of distinct mediums that is different from a second spacing between a second set of distinct mediums of the series of distinct mediums.

8. The printer of claim 5, wherein the adjacent distinct mediums have leading edges at different offsets from the printing area and the printer is configured to print on a series of distinct mediums in a same printing lane, each of the series of distinct mediums having a different offset with respect to a next distinct medium in the series.

9. The printer of claim 2, wherein the plurality of printing lanes comprise three or more printing lanes.

10. The printer of claim 9, wherein the printer further comprises:

at least one additional shared printer head configured to simultaneously print portions of independent images onto each of two adjacent distinct mediums of the plurality of distinct mediums traversing the printing area in parallel.

11. The printer of claim 10, wherein the shared printer head and the additional shared printer head are configured to print portions of an independent image onto a single medium.

12. The printer of claim 9, further comprising:

a plurality of sensors configured to detect positions of the plurality of distinct mediums in the plurality of printing lanes relative to the plurality of printer heads, wherein the plurality of printer heads print the plurality of independent images based on the positions of the plurality of distinct mediums.

13. The printer of claim 12, wherein the plurality of sensors comprise at least one sensor configured to detect positions of the plurality of distinct mediums in each of the plurality of printing lanes relative to the printer heads.

14. The printer of claim 9, wherein the printer is configured to print on distinct mediums having variable areas on which independent images are printed.

* * * * *